US012595146B2

(12) United States Patent
Kohn et al.

(10) Patent No.: US 12,595,146 B2
(45) Date of Patent: Apr. 7, 2026

(54) HAND DISPENSER FOR STRETCH WRAP COMPRISED OF PAPER OR CARDBOARD

(71) Applicants: Steve Kohn, Short Hills, NJ (US); Amy Rigazio, Farmingdale, NY (US); Jaime Radakovich, Roselle Park, NJ (US); Steve Guerra, Ambler, PA (US)

(72) Inventors: Steve Kohn, Short Hills, NJ (US); Amy Rigazio, Farmingdale, NY (US); Jaime Radakovich, Roselle Park, NJ (US); Steve Guerra, Ambler, PA (US)

(73) Assignee: BROADWAY HOLDINGS I, LLC, Monroe, NJ (US)

( * ) Notice: Subject to any disclaimer, the term of this patent is extended or adjusted under 35 U.S.C. 154(b) by 257 days.

(21) Appl. No.: 18/223,493

(22) Filed: Jul. 18, 2023

(65) Prior Publication Data

US 2023/0356970 A1 Nov. 9, 2023

Related U.S. Application Data

(60) Division of application No. 17/317,680, filed on May 11, 2021, now Pat. No. 12,227,378, and a continuation-in-part of application No. 16/439,641, filed on Jun. 12, 2019.

(51) Int. Cl.
*B65H 16/00* (2006.01)

(52) U.S. Cl.
CPC ... *B65H 16/005* (2013.01); *B65H 2701/1752* (2013.01); *B65H 2701/1842* (2013.01)

(58) Field of Classification Search
CPC ..... B65H 16/005; B65H 2701/1752; B65H 2701/1842; B65H 2402/412; B65H 2701/1944; B65H 23/06; B65B 67/085
See application file for complete search history.

(56) References Cited

U.S. PATENT DOCUMENTS

| | | | | |
|---|---|---|---|---|
| 4,179,081 | A * | 12/1979 | Parry | B65H 75/185 242/588 |
| 4,484,717 | A * | 11/1984 | Goldstein | B65H 75/30 242/588 |
| 2006/0175462 | A1* | 8/2006 | Becker | B65H 16/04 242/588.2 |
| 2013/0074446 | A1* | 3/2013 | Windheuser | B65B 67/085 53/203 |
| 2015/0166285 | A1* | 6/2015 | Stanton | B65B 67/085 242/422 |
| 2016/0289033 | A1* | 10/2016 | Love | B65H 75/185 |
| 2018/0257889 | A1* | 9/2018 | Walters | B65B 67/085 |
| 2021/0261370 | A1* | 8/2021 | Kohn | B65H 16/005 |

FOREIGN PATENT DOCUMENTS

| | | | | |
|---|---|---|---|---|
| WO | WO-2014041509 | A1 * | 3/2014 | B65B 67/085 |

* cited by examiner

*Primary Examiner* — William A. Rivera
(74) *Attorney, Agent, or Firm* — Philip M. Weiss; Weiss & Weiss

(57) ABSTRACT

A film dispenser for dispensing stretch wrap or other flexible materials. The film dispenser is comprised of paper or cardboard. The film dispenser being inserted into an extended core or having the extended core inserted into the film dispenser.

6 Claims, 9 Drawing Sheets

HAND DISPENSER FOR STRETCH WRAP COMPRISED OF PAPER OR CARDBOARD

RELATED APPLICATION

This application is a divisional of U.S. patent application Ser. No. 17/317,680 filed May 11, 2021, which is a continuation in part of U.S. patent application Ser. No. 16/439,641 filed Jun. 12, 2019.

FIELD OF THE INVENTION

The present invention relates to a hand dispenser for stretch wrap or other flexible materials, the hand dispenser comprised of paper or cardboard.

BACKGROUND OF THE INVENTION

U.S. Pat. No. 4,722,493 relates to a holder for dispensing stretch film from a roll comprising a cylindrical body and an arbor rotatably supported on the body. A flexible grip having internal ribs covers the body and arbor, and by applying finger pressure to the grip brake rotation of the arbor and controls film tension. The holder comprises a handle with a substantially cylindrical body and a shaft extending from one end of the body. An arbor is journaled on the shaft. Means on the arbor engage the film roll, constraining the roll and arbor to rotate together on the shaft. A collar is on the arbor adjacent the handle. Holding the handle may create a braking torque on the roll by applying radial pressure to the collar.

U.S. Pat. No. 5,203,517 relates to a dispenser for a stretch wrap film with cylindrical bearings. The dispenser has a spindle at the end which forms a hub which attaches to the core of the film roll and rotates with the roll as film is unwound. The spindle extends coaxially from the core of the film roll and is partially surrounded by a flexible hand grip. Bearings are mounted on the spindle and interposed beneath part of the hand grip so the spindle may rotate freely with respect to the hand grip. Part of the hand grip engages the spindle without interposition of bearings. The dispenser requires a first sleeve bearing mounted on the shaft adjacent the hub, a brake drum mounted on the shaft adjacent the first sleeve bearing, a second sleeve bearing mounted on the shaft adjacent the other end of the brake drum and a single flexible hand grip.

U.S. Pat. No. 4,575,020 relates to a portable chuck for dispensing under tension a roll of wrapping material. The chuck includes an expandable spindle insertable within one end of the tubular core, and a handle for expanding the spindle to create a braking force. The chuck is formed from pieces, each of which includes a spindle portion, collar and handle portion. A fulcrum is disposed between the chuck pieces above the collar.

U.S. Pat. No. 4,522,348 relates to a dispenser for stretch film having a manual braking mechanism. First and second side members are adjacent to each side of a roll wrapping material. Each side member has a bearing member disposed thereon for supporting the core. At least one bearing member is insertable into the core and has an expandable bearing surface.

U.S. Pat. No. 5,094,395 relates to an apparatus and method for dispensing plastic stretch film wherein a hollow core supply roll of stretch film is dispensed utilizing a brake means mounted within the core. This urges by its own resiliency against the inside surface of the core while permitting frictionally retarded axially rotation of the core about the brake and having handles connected to the brake means.

U.S. Pat. No. 4,714,211 relates to a dispenser for applying plastic packaging film under tension about an object. The dispenser comprises a base with a handle and a roll support at opposite ends. The roll support comprises a tube that is adjustable relative to the base. A means to secure the tube in a selected position, together with tension applying means in connection with a hand grip attached to the upper end of the roll support.

U.S. Pat. No. 5,311,725 relates to a stretch wrap packaging machine having a support frame and rotatable frame rotatably mounted on the support frame. Dispenser is mounted on the rotatable frame to follow an orbital path and has a web tensioning system. At least one actuation ring is mounted on support frame. Activator moves the actuation ring to cooperate with the tensioning system.

U.S. Pat. No. 5,941,049 relates to a method and apparatus for stretch wrapping a load. A leading end of packaging is placed in a retainer to hold the leading end of the packaging. Packaging material is dispensed from a packaging material dispenser, and relative rotation is provided between the dispenser and a load to wrap packaging around the load. Packaging is automatically released from the retainer in response to force applied by packaging wrapped around the load or unpowered actuation.

U.S. Pat. No. 4,102,513 relates to a dispenser for wrapping a roll of plastic stretch film under tension about an object. The dispenser has a reel assembly with adjustable drag arrangement to set and adjust tension on the film during wrapping by manipulation of a hand grip. Two hand grips are connected to and arranged relative to the reel assembly for balance support during wrapping. One hand grip is associated with one of a pair of rotary end supports for the roll of film so that movement of one hand grip changes drag on the roll and thereby tension on the film during wrapping.

U.S. Design Pat. 317,394 and 382,429 relate to handheld dispensers for stretch wrap film.

U.S. Pat. No. 4,179,081 relates to an apparatus for manual application of plastic stretch films. The apparatus consists of an extended core for supply of plastic stretch film and a pair of tubular grip means for the extended core. Grip means serve as manual control for paying out the plastic stretch film and as manual means for applying tension on the film. This requires a pair of flexible hand grips.

U.S. Pat. No. 4,248,392 relates to an apparatus for application of plastic stretch films, consisting of a pair of insertable adaptors for the ends of a cylindrical core which hold a supply of plastic stretch film and pair of tubular grip means for insertable adapters. This requires a pair of insertable adapters and a pair of flexible hand grips.

U.S. Pat. No. 4,477,037 relates to a stretch wrap film dispenser where film is wound on a core which is longer than the roll of film to extend out of both ends. A rotatable handle is mounted on the core outboard of the film. Brake nib between the handle and core is adjusted by a screw thread.

U.S. Pat. No. 4,817,762 relates to a dispenser handle for rolls of flexible sheet material. The handle includes a spindle carrying at one end locking means insertable into an opening of a hollow cylindrical core on which sheet material is wound. The spindle is of reduced diameter and carries a collapsible sleeve which may be squeezed to brake the spindle and hence the rate at which material is stripped from the roll.

U.S. Pat. No. 5,915,642 relates to a dispenser handle for rolls of flexible sheeting material, having an insert having radially extending fins and a grip surface. The handle is inserted into a hollow core. The fins provide a fit that allows the core to rotate relative to the handle. The fins can deform when subjected to such rotation. The grip is positioned to allow the user to squeeze the handle against the core to slow or stop rotation.

U.S. Pat. No. D 612,179 relates to a stretch film dispenser.

U.S. Pat. No. 7,726,600 relates to a stretch film dispenser including a base, reel device, and brake device. The reel device has a reel and connecting member pivotally connected to the base, and the brake device is connected to the base and fitted to the connecting member of the reel device. The base and brake device form a holding member of the dispenser to be grasped by the user.

US patent publication 2009/0050729 relates to a stretch film dispenser including a base, reel and two brake devices. The reel is connected to the base for rotation. Brake devices are connected to two flexible members on an outer annular wall of the base to be pressed for braking the reel.

US patent publication 2009/0309968 relates to a push-to-expand mandrel for stretch wrap hand tool. A dispenser uses coreless rolls. Mandrel can move between a retracted position and an increased diameter position.

U.S. Pat. No. 4,535,951 relates to a stretch film wrapping device for supporting a roll of plastic film having a tubular rigid core including a pair of opposed core holders interconnected by an adjustable axle member to effect clamping of the film roll between core holders. Bottom core holder is mounted on a base member. Top core holder is mounted on the axle member.

U.S. Pat. No. 5,046,298 relates to a method of wrapping a roll wherein a sleeve wrap having a width substantially equal to the width of the paper roll is wrapped around the cylindrical portion of the roll. A head of the same size and the end of the roll is coupled to each end of the roll. A stretch wrap is wrapped around ends of the roll so approximately one-half of the stretch wrap covers a portion of the end of the roll and the other one-half lies in the same place as the head.

U.S. Pat. No. 4,484,717 relates to a stretch-wrap film on a roll using manual grasp on handles mounted on each of the roll and freely rotatable thereon. A brake ringer under at least one index finger can be clamped by that finger onto the spindle running with the stretch-wrap film roll, to apply braking and consequent stretch-wrap film tension. Stretch wrap film is wound around a core, a cylindrical tube usually made of cardboard. The core extends beyond the ends of the roll so that the dispenser handles may be applied. The handle may be a cardboard tube, but a brake ring is made of suitably resilient, high friction material where forces are required of the index finger.

U.S. Pat. No. 10,077,137 relates to a combination carrying device that includes a rigid basket having a flexible nest therein. The flexible device may be formed from one or more fabrics or like materials and or define a tapered volume having a pair of handle extensions.

US patent publication 2011/0219631 relates to plastic cutlery and tableware made in at least two parts joinable to form a unitary utensil, serving piece, beverage container or non-food contacting tableware in which the two parts are made of different materials. The materials of the two parts differ in at least one of the following: color, type of plastic, grade of plastic, source of plastic, and additives such as presence of an anti-microbial agent, transparency, or reflectivity. Food grade resins, for example, can be used for the heads of cutlery while recycled resins can be used for handles. Heads can be separately metallized and then joined to non-metallized handles.

US patent publications 2012/0046411 and 2015/0218354 relate to compositions including recycled resin components and medical devices and components made from such compositions. The compositions and medical devices are characterized as biocompatible and sterilization stable. The compositions include a recycled resin component and may include one or more of an antioxidant component, slip additive component, and anti-static component.

US patent publication 2009/0126204 relates to a product formed from a crop-based resin that decomposes within 120 days or less and is heat resistant being able to remain in hot water at a temperature of at least 190 degrees Fahrenheit for at least 15 minutes without any substantial loss in rigidity.

Handles that are used to dispense stretch film from a roll are historically produced using virgin polymers such as polyvinyl chloride or polypropylene. This is true for handles that are inserted in a roll's inner core, for handles that are placed over a roll's outer core, and for handles that are used in coreless applications. Consumers are looking to produce less plastic waste and are requesting more sustainable options.

SUMMARY OF THE INVENTION

The present invention relates to a film dispenser comprising paper or cardboard. The film dispenser is used in a single handle application with an extended core that extends past an edge of a stretch film that is wound around the extended core. The film dispenser is inserted over a section of an extended core having no film wound around the core, and a further section of the extended core has film would around the extended core. The film dispenser has an opening on top for an extended core to be inserted. The film dispenser slides over the extended core. The film dispenser acts as a braking mechanism when it is squeezed to increase tension on the film as it is being unrolled.

It is an object of the present invention for the film dispenser to further comprise an opening on bottom and a slit on the side. It is an object of the present invention for the bottom to be closed. It is an object of the present invention for the opening on the bottom to have a cap on it.

It is an object of the present invention for the film dispenser to have a collar. It is an object of the present invention for the collar of the film dispenser to keep a hand off the edge of the roll as the roll unwinds. It is an object of the present invention for the collar to comprise paper or cardboard.

It is an object of the present invention for walls of the film dispenser to be deformable so the walls can be squeezed by pressure from a hand, and when pressure is released, the walls return to their normal location.

It is an object of the present invention for the film dispenser to comprise ribs. It is an object of the present invention for the ribs to be comprised of paper or cardboard. It is an object of the present invention for the ribs to be comprised of plastic. It is an object of the present invention for the ribs to be located internally in the film dispenser to assist in braking when a force is applied to the film dispenser and the ribs are pressed against the extended core.

It is an object of the present invention for the film dispenser to be reusable. It is an object of the present invention for the film dispenser to be disposable. It is an object of the present invention for the film dispenser to be recyclable. It is an object of the present invention for the stretch film to be from 2" to 15" wide.

It is an object of the present invention for the film dispenser to consist of paper of cardboard.

It is an object of the present invention for the film dispenser to comprise an inner mold and an outer mold, both comprising paper or cardboard.

The present invention relates to a film dispenser and extended core in combination comprising: the film dispenser and extended core comprised of paper or cardboard. The film dispenser has an opening on top for an extended core to be inserted. The film dispenser when squeezed touches the extended core causing friction, which when increasing the amount of force applied to the extended core, slows down and stops the extended core from spinning and dispensing film.

It is an object of the present invention for the film dispenser to comprise ribs inside the film dispenser to assist in braking when a force is applied to the film dispenser and the ribs are pressed against the extended core. It is an object of the present invention for the ribs to consist of paper of cardboard. It is an object of the present invention for the ribs to consist of plastic.

It is an object of the present invention for the film dispenser to comprise a collar. It is an object of the present invention for the collar to be comprised of paper of cardboard. It is an object of the present invention for the collar to be comprised of plastic.

It is an object of the present invention for the film dispenser and extended core to have the walls of the film dispenser be deformable so that the walls can be squeezed by pressure from a hand, and when pressure is released, the walls return to their normal location.

It is an object of the present invention for there to be a difference between the coefficient of friction of the film dispenser and the extended core that allows the extended core to turn and release film when squeezing force is reduced and the film dispenser no longer touches the extended core.

It is an object of the present invention for the extended core to have a groove in it that a ridge from the film dispenser fits within and locks the film dispenser onto the extended core. It is an object of the present invention for the extended core to have a groove which will attach to a ridge on the inside of a film dispenser to keep the extended core aligned with the film dispenser.

It is an object of the present invention for the film dispenser and extended core to be reusable. It is an object of the present invention for the film dispenser and extended core to be disposable. It is an object of the present invention for the film dispenser and the extended core to consist of paper or cardboard.

It is an object of the present invention for the film dispenser to comprise an inner mold and an outer mold both comprising paper or cardboard. It is an object of the present invention for the inner mold to be comprised of openings and for the outer mold to be comprised of protrusions which fit into the openings of the inner mold; the outer mold having a higher coefficient of friction than the extended core. It is an object of the present invention for the inner mold to sit within the outer mold.

It is an object of the present invention for the inner mold to comprise a ridge that fits into a groove formed in the extended core when the extended core is placed within the film dispenser.

It is an object of the present invention that when the outer mold is squeezed that it touches the extended core through the openings of the inner mold, causing friction which slows down or stops the extended core from spinning and dispensing film.

The present invention relates to a combination of film dispensers and an extended core comprising: two film dispensers comprised of paper or cardboard. Film is wound around the center of the extended core. The extended core protrudes from both ends of the extended core having the film. A film dispenser is inserted over each end of the extended core. When each of the film dispensers are squeezed, each of the film dispensers touches the extended core causing friction, which when increasing the amount of force applied to the extended core, slows down and stops the extended core from spinning and dispensing film.

It is an object of the present invention for the combination of film dispensers and extended core to dispense the film using two hands.

It is an object of the present invention for the combination of film dispensers and extended core to consist of paper or cardboard.

The present invention relates to a film dispenser comprised of paper or cardboard. The dispenser is inserted into a core of a stretch wrap film. The film dispenser is used as a braking mechanism, so when squeezed, the outer part of the film dispenser touches the core of the stretch wrap film, causing friction and functioning as a braking mechanism to stop film from being dispensed.

It is an object of the present invention for the film dispenser and the core of the stretch wrap film to have different coefficients of friction.

It is an object of the present invention for the film dispenser to comprise a cylinder with side walls and a closed or open bottom, wherein the top of the film dispenser has a plug or extension that fits within the core of stretch wrap film in a way that the film dispenser is held within the core but can be removed with some degree of force.

It is an object of the present invention for the film dispenser to be used in coreless applications of stretch wrap film.

The present invention relates to multiple film dispensers each comprised of paper or board. The two film dispensers slide into a stretch film roll's inner core, each from opposite sides. It is an object of the present invention for the stretch film to be coreless.

The present invention relates to a film dispenser made from paper or cardboard wherein an insert portion of the film dispenser is inserted into a stretch film roll's inner core. The film dispenser has an outer surface which is held by a user when unrolling the stretch film. The film dispenser's insert portion is sized to fit snuggly within the inner core while the outer surface of the film dispenser is wide and stays located outside of the core. The film dispenser acts as a braking mechanism when dispensing the stretch film. It is an object of the present invention for the user to squeeze the insert portion inside the inner core so that the insert portion touches the core causing friction that increases tension on the film as it is being unrolled.

The present invention relates to a film dispenser comprising a multi-piece handle made from paper or cardboard designed for coreless application of stretch film. In place of a core, a section above the handle is inserted through the center of the roll of film leaving the graspable dispenser area made of cardboard or paper extended past an edge of the stretch film. It is an object of the present invention for a collar to be above the graspable dispenser area. The graspable dispenser area extends past the edge of the coreless film. The film dispenser acts as a braking mechanism when dispensing the stretch film.

It is an object of the present invention for the extended core to extend past an edge of the stretch film. It is an object of the present invention for the film dispenser, once the extended core is fully inserted into the film dispenser, to become fully seated (snapped into place) before the film dispenser contacts the wound film. The present invention relates to film dispensers made from paper or cardboard designed to be placed over each end of a stretch film roll's extended core. Each end of the extended core protrudes from each side where the extended core has the film. It is an object of the present invention to provide a film dispenser on each side of the film so the film can be applied to an object or objects by using two hands. Each film dispenser has an outer surface which the user holds when unrolling the film.

It is an object of the present invention for the inner core of the film dispenser to be approximately flush with both edges of the stretch film. It is an object of the present invention for the insert portion of a first film dispenser to slide into the core on one end of the roll, and for the insert portion of a second film dispenser to be installed into the opposite end in the same manner.

It is an object of the present invention to slide a roll of stretch film onto the dispenser and to have the roll of film snap into place onto the dispenser. It is an object of the present invention for the film dispenser to be easily removed from the extended core of the stretch wrap film.

It is an object of the present invention to provide a stretch wrap film dispenser wherein the roll of film is easily replaced. It is an object of the present invention to provide a stretch wrap film dispenser which can be adjusted to accommodate different widths of film rolls.

When dispensing the film, the user holds the film dispenser and the extended core turns, releasing the film. When squeezed, the film dispenser touches the extended core causing friction, which when increasing the amount of force applied to the extended core, causes spinning of the extended core to slow down and the device to stop dispensing film. By varying the grip force on the dispenser, the user can control the braking action of the dispenser and thus the tension of the film. It is an object of the present invention for a low coefficient of friction between the film dispenser and the extended core to allow the extended core to turn and release the film when the squeezing force is reduced. It is an object of the present invention for the film dispenser to no longer touch the core when squeezing force is no longer applied to the film dispenser. Thus, the dispenser provides the user with accurate tension control from free spinning the dispenser to stopping the dispensing of the film completely by simply increasing the gripping force on the dispenser. It is an object of the present invention for a small amount of tension to activate the film's holding power.

It is an object of the present invention for the film dispenser to have a manually operable braking system that is adjustable to permit the film application with braking tension as different degrees of pressure are applied to the film dispenser. It is an object of the present invention for the tension in the film to be controllable during the wrapping process.

It is an object of the present invention to provide a stretch wrap film dispenser which has good balance and facilitates the application of film under substantially uniform tension across the full width of the film. It is an object of the present invention for the film dispenser to allow a user to dispense the stretch film that is wrapped around the roll about an object or objects.

The present invention relates to an extended core and film dispenser both produced from paper or paper products. The film dispenser is a separate device that is used with the extended core. The film dispenser is either inserted in the core of the stretch wrap film or the film dispenser is placed over the extended core. It is an object of the present invention for the extended core and the film dispenser to have different coefficients of friction. The different coefficients of friction permit the film dispenser to function as a braking mechanism when the film dispenser is squeezed as the resulting friction of the inner part of the film dispenser against the extended core stops the film from being dispensed. It is an object of the present invention for the inside of the film dispenser to comprise ribs or other projections extending from the inner surface of the film dispenser. It is an object of the present invention for the walls of the film dispenser to be deformable so that they can be squeezed by pressure from a user's hand, and when the pressure is released, the walls return to their normal location.

It is an object of the present invention for the film dispenser to have a handle that comprises a cylinder with side walls and a closed bottom. It is an object of the present invention for the film dispenser to have a handle that comprises a cylinder with side walls and an open bottom.

It is an object of the present invention for the top of the cylinder to have a plug or extension that fits within an inner core of an extended core in a way that the film dispenser is held within the core but can be removed with some degree of force.

It is an object of the present invention for the film dispenser to comprise a cylinder with side walls having an opening at the top of the cylinder, side walls, and a closed bottom. It is an object of the present invention for the film dispenser to have a collar extending from the top of the opening of the cylinder.

It is an object of the present invention for the film dispenser to be a single-piece construction. It is an object of the present invention for the film dispenser to be comprised of multiple pieces, such as side wall, bottom piece and internal pieces, e.g., the internal piece being a plug.

It is an object of the present invention for the handles to be used in two handle applications for the rolls of stretch film from 8" to 30" wide.

It is an object of the present invention for the film dispenser to comprise environmentally sustainable material. It is an object of the present invention for the film dispenser to be made of paper-based material. It is an object of the present invention for the film dispenser to be made of a material that can be recycled as part of a mixed paper stream.

It is an object of the present invention for the film dispenser to reduce tendency of the film to bind together. It is an object of the present invention to not have a groove in an extended core. It is an object of the present invention to increase the ease of use of the film dispenser.

It is an object of the present invention for the use of the film dispenser of the present invention to not require the need for silicone spray on the extended core. It is an object of the present invention for the film dispenser to improve ease of storage and merchandising, such as by incorporating a hook or loop on the film dispenser so that the film dispenser can be pegged on a merchandising display. It is an object of the present invention for the film dispenser to have an ergonomic handle shape.

DETAILED DESCRIPTION OF THE INVENTION

Figure 1A:
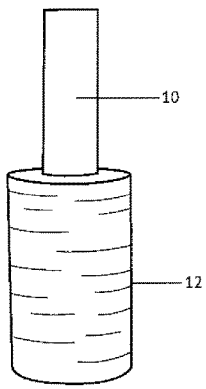
FIG. 1*a* shows a side view of an extended core that has film wound around the core.

FIG. 1*a* shows a side view of the extended core 10 having film 12 wound around the extended core 10.

Figure 1B:
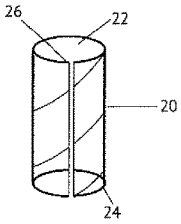
FIG. 1*b* shows a side internal view of a cardboard film dispenser.

FIG. 1*b* shows an internal view of film dispenser 20 made of cardboard or paper. The film dispenser 20 having an opening 22 on top, an opening 24 on bottom and a slit 26 on the side.

Figure 1C:
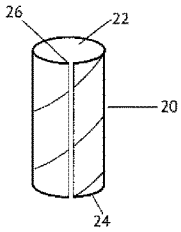
FIG. 1*c* shows a side external view of a cardboard film dispenser.
Figure 1D:
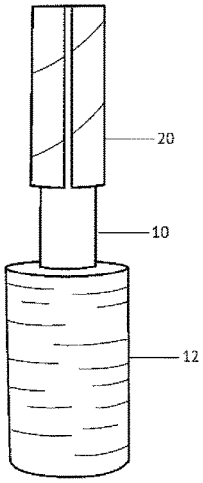
FIG. 1*d* shows a side view of the cardboard film dispenser of FIG. 1*c* partially inserted over the extended core of FIG. 1*a*.

FIG. 1*c* shows a side external view of a film dispenser 20 made of cardboard or paper. The film dispenser 20 having an opening 22 on top, an opening 24 on bottom and a slit 26 on the side.

Figure id shows a side view of the cardboard or paper film dispenser 20 of FIG. 1*c* partially inserted over the extended core 10 of FIG. 1*a*, wherein the extended core 10 has film 12 wound around the extended core 10.

Figure 1E:
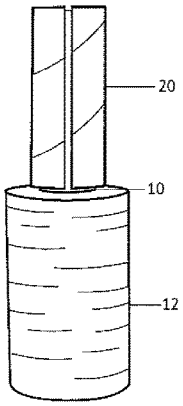
FIG. 1*e* shows a side view of the cardboard film dispenser of FIG. 1*c* fully inserted over the extended core of FIG. 1*a*.
Figure 1F:
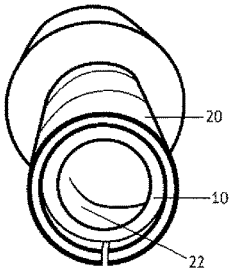
FIG. 1*f* shows a bottom view of the open cardboard film dispenser of FIG. 1*e*.

FIG. 1*e* shows a side view of the cardboard or paper film dispenser 20 of FIG. 1*c* fully inserted over the extended core 10 of FIG. 1*a*, wherein the extended core 10 has film 12 wound around the extended core 10. The film dispenser 20 approximately touches the edge of the film 12.

Figure if shows a bottom view of the FIG. 1*e* showing an open bottom 22 of film dispenser 20 which surrounds extended core 10.

Figure 2A:
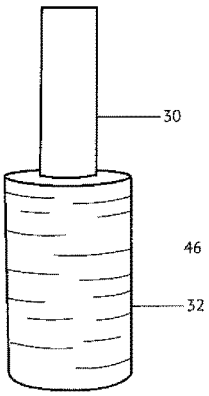
FIG. 2*a* shows a side view of an extended core that has film wound around the core.

FIG. 2*a* shows a side view of the extended core 30 having film 32 wound around the extended core 30.

Figure 2B:
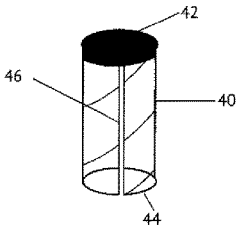
FIG. 2*b* shows a side internal view of a cardboard film dispenser with a capped end.

FIG. 2*b* shows a side internal view of a film dispenser 40 made with cardboard or paper. The film dispenser 40 has a capped end 42, an open end 44 and a side slit 46.

Figure 2C:
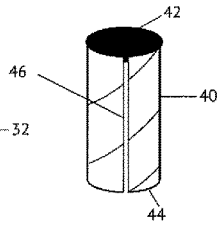
FIG. 2*c* shows a side external view of a cardboard film dispenser with a capped end.

FIG. 2*c* shows a side external view of film dispenser 40 made with cardboard or paper. The film dispenser 40 has a capped end 42, an open end 44 and a side slit 46.

Figure 2D:
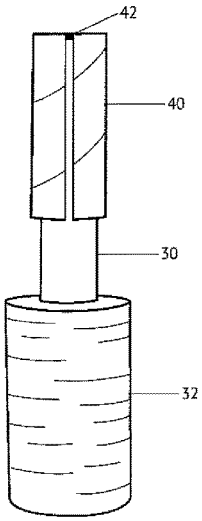
FIG. 2*d* shows a side view of the cardboard film dispenser of FIG. 2*c* partially inserted over the extended core of FIG. 2*a*.

FIG. 2*d* shows a side view of the cardboard or paper film dispenser 40 of FIG. 2*c* partially inserted over the extended core 30 of FIG. 2*a*, wherein the extended core 30 has film 32 wound around the extended core 30. The dispenser 40 has a capped end 42.

Figure 2E:
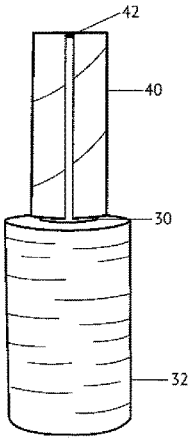
FIG. 2*e* shows a side view of the cardboard film dispenser of FIG. 2*c* fully inserted over the extended core of FIG. 2*a*.

FIG. 2*e* shows a side view of the cardboard or paper film dispenser 40 of FIG. 2*c* fully inserted over the extended core 30 of FIG. 2*a*, wherein the extended core 30 has film 32 wound around the extended core 30. The dispenser 40 has a capped end 42.

Figure 2F:
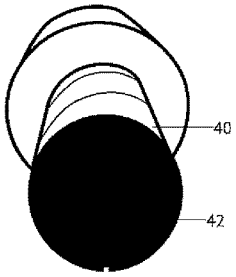
FIG. 2*f* shows a bottom view of a capped film dispenser of FIG. 2*e*.

FIG. 2*f* shows a bottom view of FIG. 2*e* having a capped end 42 of a film dispenser 40 which surrounds an extended core (not shown).

Figure 3:
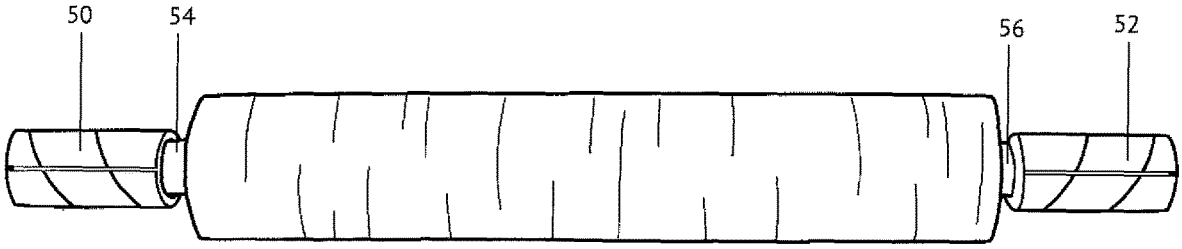
FIG. 3 shows a side view of extended cores inserted into film dispensers on both sides of the roll of film.

FIG. 3 shows a side view of film dispensers 50 and 52 made of cardboard or paper inserted over extended cores 54 and 56.

Figure 4A:
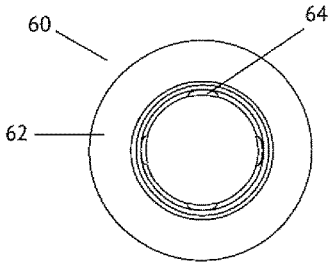
FIG. 4*a* illustrates a top view of the film dispenser of the present invention.

FIG. 4*a* is a top view of a film dispenser 60 made of paper or cardboard. The film dispenser 60 has a collar 62 and ribs 64.

Figure 4B:
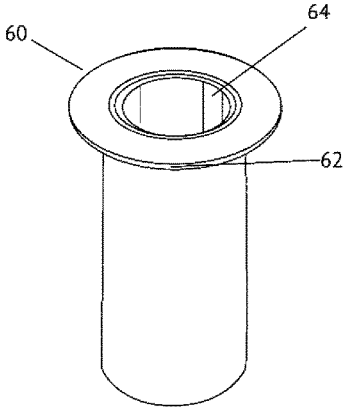
FIG. 4*b* illustrates a top side view of the film dispenser of the present invention.

FIG. 4*b* shows a top side view of the film dispenser 60 made of paper or cardboard having a collar 62 and ribs 64.

Figure 4C:
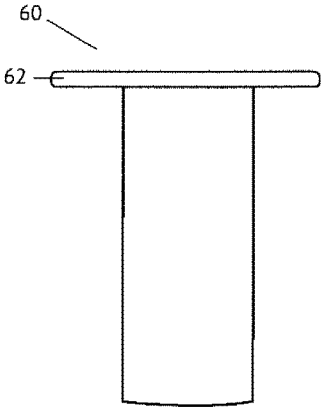
FIG. 4*c* illustrates a side view of the film dispenser of the present invention.

FIG. 4*c* shows a side view of the film dispenser 60 made of paper or cardboard having a collar 62.

Figure 5:
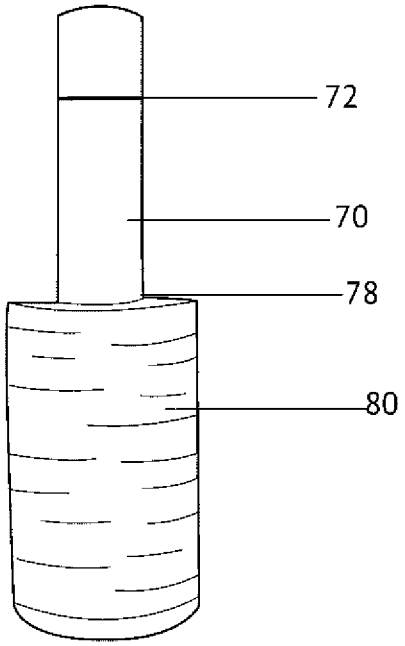
FIG. 5 shows a side view of the extended core that has film wound around the core.

FIG. 5 shows a side view of the extended core 70 that extends past an edge 78 of the stretch film 80. It is optional that the extended core 70 has a groove 72 which will attach to a ridge (not shown) on the inside of a film dispenser.

Figure 6A:
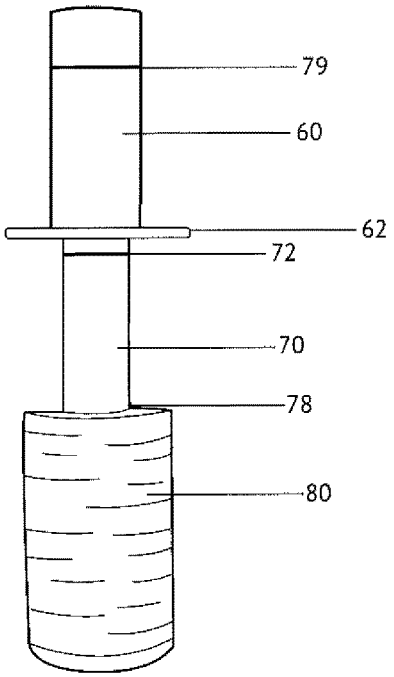
FIG. 6*a* shows a side view of the extended core that has film wound around the core; the extended core about to be inserted into the film dispenser.

FIG. 6*a* shows a side view of the film dispenser 60 and extended core 70, the film dispenser 60 made from paper or cardboard having a collar 62, the film dispenser 60 in use as a single handle application. The extended core 70 extends past an edge 78 of the stretch film 80. It is optional that the extended core 70 has a groove 72 which will attach to a ridge 79 (shown internally) on the inside of the film dispenser 60.

Figure 6B:
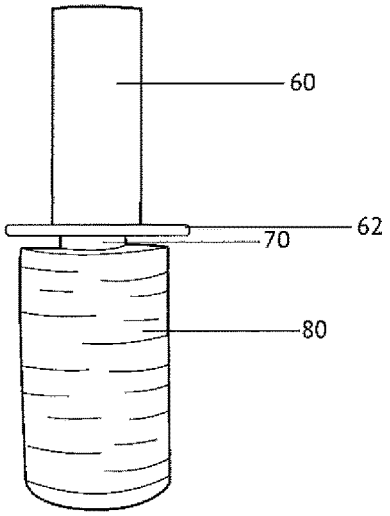
FIG. 6*b* shows a side view of the extended core fully inserted into the film dispenser.

FIG. 6*b* shows a side view of the extended core 70 fully inserted into the film dispenser 60 made of paper or cardboard; the film dispenser 60 having a collar 62, slides over the extended core 70 and becomes fully seated before becoming approximately flush with contacting the film 80.

Figure 7A:
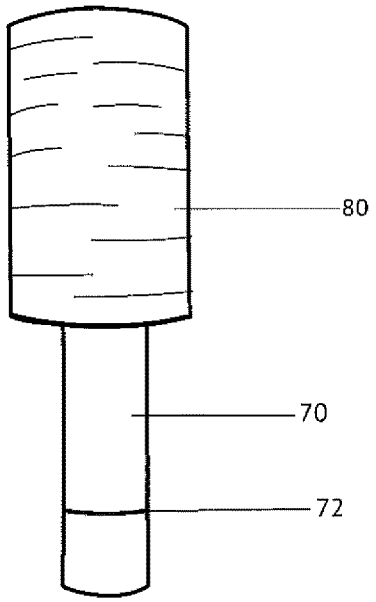
FIG. 7*a* shows a side view of the extended core that has film wound around the core.

FIG. 7*a* shows a side view of the extended core 70 having film 80 wound around an extended core 70, the extended core 70 having a groove 72 (optional) which when placed in the film dispenser (not shown) of the present invention fits into a ridge (not shown) to keep the extended core 70 in place.

Figure 7B:
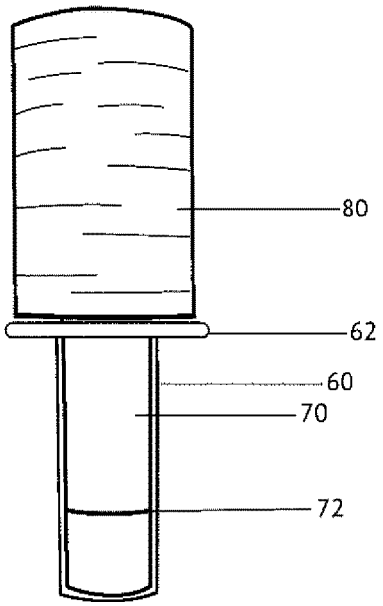
FIG. 7*b* shows a side internal view of the extended core inserted into the film dispenser.

FIG. 7*b* shows a side internal view of the extended core 70 of FIG. 7*a* with the film dispenser 60 made of paper or cardboard having a collar 62. The extended core 70 has a groove 72 that fits into a ridge (not shown) of the film dispenser 60.

Figure 8A:
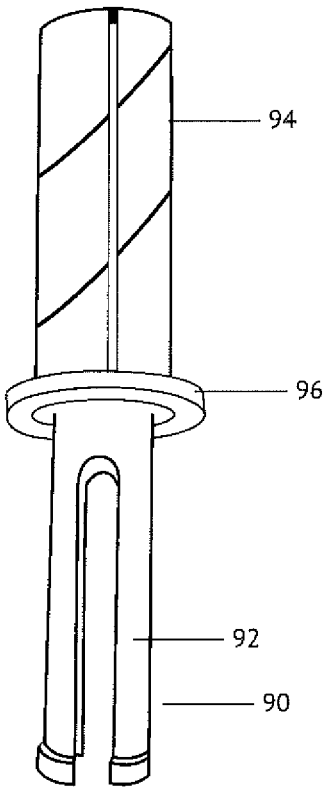
FIG. 8*a* shows a side view of components of a film dispenser designed for a coreless application.

FIG. 8*a* shows a side view of multi-piece handle 90 designed for a coreless application. In place of a core, section 92 is inserted through the center of the roll of film leaving a graspable dispenser area 94 made of cardboard or paper extended past the edge of the film. A collar 96 is on top of the graspable dispenser area 94.

Figure 8B:
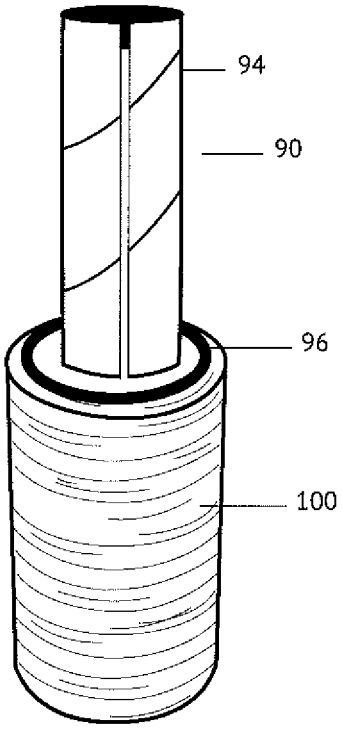
FIG. 8*b* shows a side view of the film dispenser of FIG. 8*a* installed in a coreless film application.

FIG. 8*b* shows a side view of the multi-piece handle 90 designed for a coreless application. Once inserted, section 92, shown in FIG. 8*a*, is located within the coreless stretch film 100 and is not visible. The graspable dispenser area 94 having a core 96 extends past the edge of the coreless film 100.

Figure 9A:
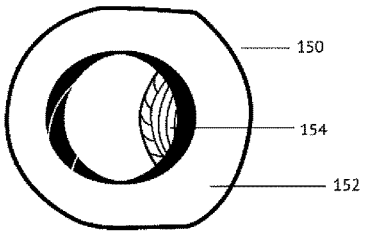
FIG. 9*a* shows a top view of a film dispenser designed to be inserted into a stretch roll's inner core.

FIG. 9*a* shows the top view of the film dispenser 150 made from paper or cardboard designed to be inserted into each side of a stretch film roll's inner core. The film dispenser 150 has an outer surface 152 which the user holds when unrolling the film. There is a braking mechanism 154 that the user will squeeze to increase tension on the film as it is being unrolled.

Figure 9B:
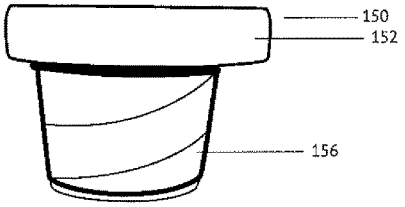
FIG. 9*b* shows an internal side view of a film dispenser designed to be inserted into a stretch film roll's inner core.

FIG. 9*b* shows a side view of the film dispenser 150 made from paper or cardboard designed to be inserted into a stretch film roll's inner core. An insert 156 is sized to fit snuggly within the inner core of a stretch film roll while the outer surface 152 of the film dispenser 150 is wide and stays located outside of the stretch film roll's inner core.

Figure 9C:
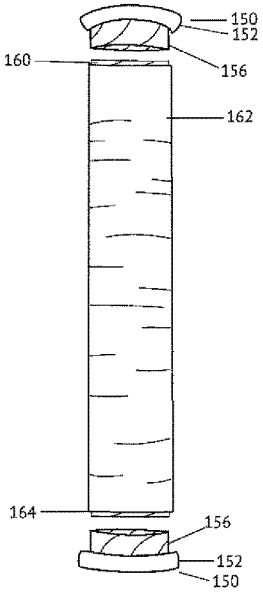
FIG. 9*c* shows a side view of the stretch film roll having two film dispensers, the type shown in FIGS. 9*a* and 9*b* about to be inserted into the stretch film roll's inner core.

FIG. 9*c* shows a side view of two film dispensers 150 made from paper or cardboard each with an outer surface 152, each dispenser 150 about to be inserted into each attached separately to each end of stretch film 162. The insert portion 156 of a first film dispenser 150 slides into the end of core 160 on one end of the roll, and a second film dispenser 150 is installed into the opposite end 164 in the same manner.

Figure 9D:
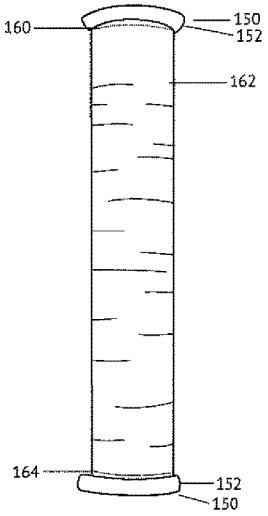
FIG. 9*d* shows a side view of the stretch film roll having two film dispensers, the type shown in FIGS. 9*a* and 9*b*, sliding into a stretch film roll's inner core in a film dispenser application.

FIG. 9*d* shows a side view of two film dispensers 150 made from paper or cardboard each with an outer surface 152, each dispenser attached separately to each end of stretch film 162. The inner core of film dispenser 150 is approximately flush with both edges of the stretch film 162. The insert portion 156 (not shown) of a first film dispenser 150 slides into the end of core 160 on one end of the roll, and a second film dispenser 150 is installed into the opposite end 164 in the same manner.

In an embodiment, the film dispenser is made of a material with a high coefficient of friction compared to the extended core of the film wrap. When squeezed the film dispenser touches the extended core. This causes friction which, when increasing the amount of force applied to the extended core, slows down and stops the extended core from spinning and dispensing film. The low coefficient of friction between the film dispenser and the extended core allows the extended core to turn and release the film when the squeezing force is reduced and the outer mold no longer touches the core.

The invention claimed is:

1. A film dispenser comprising:

said film dispenser comprised of paper or cardboard;

said film dispenser inserted into a core of a stretch wrap film;

said film dispenser used as a braking mechanism, so when squeezed, outer part of said film dispenser touches said core of said stretch wrap film, causing friction and functioning as said braking mechanism to stop film from being dispensed;

said film dispenser and said core of said stretch wrap film have different coefficients of friction.

2. The film dispenser of claim 1 wherein said film dispenser comprises a cylinder with side walls and a closed or open bottom and wherein top of said film dispenser has a plug or extension that fits within said core of stretch wrap film in a way that said film dispenser is held within said core but can be removed with some degree of force.

3. The film dispenser of claim 1 wherein said film dispenser is used in coreless applications of stretch wrap film.

4. A multiple film dispenser application comprising:

two film dispensers each comprised of paper or cardboard;

said two film dispensers sliding into a stretch film roll's inner core, each from opposite sides;

said film dispensers and said core of said stretch wrap film have different coefficients of friction;

each of said film dispensers used as a braking mechanism, so when squeezed, outer part of each of said film dispensers touches said core of said stretch wrap film, causing friction and functioning as said braking mechanism to stop film from being dispensed.

5. The multiple film dispenser application of claim 4 wherein said stretch film is coreless.

6. A film dispenser comprising:

said film dispenser made from paper or cardboard;

said film dispenser inserted into a stretch film roll's inner core;

said film dispenser having an outer surface which is held by a user when unrolling said stretch film;

said film dispenser's insert portion sized to fit snuggly within said inner core while outer core surface is wide and stays located outside of said core;

said film dispenser and said core of said stretch wrap film have different coefficients of friction;

said film dispenser acting as a braking mechanism when dispensing said stretch film.

* * * * *